US007661484B2

(12) United States Patent
Berger et al.

(10) Patent No.: US 7,661,484 B2
(45) Date of Patent: Feb. 16, 2010

(54) DRILLING HAMMER AND/OR PERCUSSIVE HAMMER HAVING A TOOL-HOLDING FIXTURE

(75) Inventors: Rudolf Berger, Grunwald (DE); Wolfgang Schmid, Munich (DE)

(73) Assignee: Wacker Neuson SE, Munich (DE)

( * ) Notice: Subject to any disclaimer, the term of this patent is extended or adjusted under 35 U.S.C. 154(b) by 383 days.

(21) Appl. No.: 10/596,334

(22) PCT Filed: Nov. 24, 2004

(86) PCT No.: PCT/EP2004/013349

§ 371 (c)(1),
(2), (4) Date: Jun. 9, 2006

(87) PCT Pub. No.: WO2005/063450

PCT Pub. Date: Jul. 14, 2005

(65) Prior Publication Data

US 2007/0163794 A1 Jul. 19, 2007

(30) Foreign Application Priority Data

Dec. 19, 2003 (DE) ..... 103 60 008

(51) Int. Cl.
*B25D 17/08* (2006.01)

(52) U.S. Cl. ..... 173/104; 173/128; 173/132; 173/201; 279/19.1; 279/19.3

(58) Field of Classification Search ..... 173/104, 173/48, 201, 132, 128; 279/19.1, 19.3, 19.5, 279/905

See application file for complete search history.

(56) References Cited

U.S. PATENT DOCUMENTS

| | | | | |
|---|---|---|---|---|
| 5,199,833 | A * | 4/1993 | Fehrle et al. | 408/239 R |
| 5,706,903 | A * | 1/1998 | Odendahl et al. | 173/104 |
| 5,971,403 | A * | 10/1999 | Yahagi et al. | 279/19.3 |
| 5,984,596 | A * | 11/1999 | Fehrle et al. | 408/226 |
| 6,073,705 | A * | 6/2000 | Shibata et al. | 173/200 |
| 6,241,026 | B1 * | 6/2001 | Wache et al. | 173/132 |
| 6,261,035 | B1 * | 7/2001 | Moores et al. | 408/239 R |
| 6,510,904 | B1 * | 1/2003 | Tyrrell | 173/132 |
| 6,984,571 | B1 * | 1/2006 | Enquist | 438/459 |
| 7,121,774 | B2 * | 10/2006 | Hirt et al. | 408/240 |
| 2003/0089509 | A1 | 5/2003 | Wanek et al. | |

FOREIGN PATENT DOCUMENTS

| | | | |
|---|---|---|---|
| DE | 3716915 | A1 | 8/1988 |
| DE | 3714679 | A1 | 10/1988 |
| DE | 4136584 | A1 | 5/1993 |
| GB | 1505907 | A | 4/1978 |

* cited by examiner

*Primary Examiner*—Scott A. Smith
(74) *Attorney, Agent, or Firm*—Boyle Fredrickson, S.C.

(57) ABSTRACT

A device for a drilling hammer and/or percussive hammer has a tool holding fixture for holding a tool and for transmitting a torque to the tool. A component of the tool holding fixture consists of a hollow cylindrical tool holder, which has an insertion opening for an insertion end of the tool, and has an impact opening, via which a percussive action can be applied to the insertion end. A stopping surface, which is stationary with regard to the tool holder and which acts in an axial direction of the tool holder, is provided in the tool holder in the area of the impact opening. The tool holding fixture is particularly suited for insertion ends according to the SDS-max standard.

20 Claims, 4 Drawing Sheets

DRILLING HAMMER AND/OR PERCUSSIVE HAMMER HAVING A TOOL-HOLDING FIXTURE

BACKGROUND OF THE INVENTION

1. Field of the Invention

The present invention relates, according to the preamble of Claim 1, to a device for a drilling and/or percussive hammer having a tool receptacle for holding a tool and transferring a torque to the tool.

2. Description of the Related Art

Such a device is known e.g. under the trade name "SDS-max," and has proven successful in practice.

A device of this sort is described in DE 37 16 915 A1. According to this patent, a percussive drilling tool has at least two grooves that open out at the end of the tool shaft, in which web-shaped dogs of a tool receptacle of the drilling hammer can engage. In addition, two recesses are provided in the tool shaft that are closed at both sides and that are situated diametrally opposite one another, in which locking elements provided on the tool shaft can engage.

The design of such a known "SDS-max" device is explained in more detail below on the basis of FIG. 1. FIG. 1 shows a sectional view of the front, tool-receiving end of a known drilling and/or percussive hammer.

In the upper half of FIG. 1, a known pneumatic spring hammer mechanism is shown in the impact position, while the lower half of FIG. 1 shows the pneumatic spring hammer mechanism in the idle position.

A component of the pneumatic spring hammer mechanism is a hollow impact piston 1, which can be set into back-and-forth motion by a drive piston (not shown) in a known manner.

On its front end, impact piston 1 strikes a header 2 that is likewise capable of axial motion, and this header in turn transmits the impact action at its opposite end to the end surface of an insertion end (not shown) of a tool (e.g., of a drill or of a chisel).

The insertion end of the tool is capable of being introduced via an introduction opening 3 into an essentially hollow cylindrical recess that forms a tool holder 4. At the end of tool holder 4 situated opposite introduction opening 3, a fictitiously defined impact opening 5 is provided through which the impact effect of header 2 can be applied to the insertion end.

Tool holder 4 is a component of a tool receptacle 6 having three web-shaped rotational drivers 7 formed on the inside of tool holder 4. Rotational drivers 7 can be inserted into rotational driver grooves (not shown) in the insertion end of the tool, as is described for example in DE 37 16 915 A1. Another rotational driver is situated opposite the two rotational drivers 7 shown in FIG. 1.

In addition, tool receptacle 6 has two locking elements 8 that are capable of axial movement in through-holes 9 of tool holder 4, and—under particular circumstances explained below—are capable of radial movement.

With the aid of a spring-loaded plate 10, locking elements 8 are fixed axially against a guide 11, so that they cannot deviate radially outwards. In this position, they are held in assigned locking recesses (not shown) in the insertion end of the tool. The locking recesses in the tool are closed on both sides in the axial direction in the tool shaft, so that locking elements 8 can prevent a tool insertion end from being withdrawn from tool holder 4.

However, the operator can move a locking sleeve 12 together with plate 10 against the action of a spring 13 (to the right in FIG. 1), whereby locking elements 8 in through-holes 9 are also moved to the right. This causes locking elements 8 to slide out of their guide 11, so that they can move radially outwards. In this way, locking elements 8 move out of their assigned locking recesses, so that the insertion end becomes capable of moving freely in the axial direction and can be withdrawn from tool holder 4.

As presented, this principle of operation is known, so that a more detailed description is not necessary.

Although tools having the brand designation "SDS-max" have developed into a kind of standard, so that the shape and execution of the insertion ends of the tools cannot be further modified to any great extent, improvements are still possible in the tool receptacle.

Thus, e.g. for the axial supporting of the insertion end, and in order to seal the pneumatic spring hammer mechanism against the entry of foreign bodies into the hammer mechanism area, a header 2 is always required that transmits the impact action from impact piston 1 to the insertion end. The resulting space requirement is relatively large, and limits the design possibilities for impact piston 1. For example, it is not easy to modify the geometry of impact piston 1 in a manner that would be desirable in order to achieve a higher impact energy. In particular in hammers having a high impact power, or a large torque that is to be transmitted, there is the danger that the insertion ends—i.e., above all the rotational driver grooves in the insertion ends—will be knocked out relatively quickly, which can result in a shortened lifespan of the tools. From GB-A-1505907, a drilling or percussive hammer is known that has a tool receptacle for holding a tool and for transmitting a torque to the tool. The tool receptacle has on its inside a locking element with which a tool end is held in the tool holder and the drive torque is transmitted to the tool end.

OBJECT AND SUMMARY OF THE INVENTION

The underlying object of the present invention is to indicate a device for a drilling and/or percussive hammer having a tool receptacle for holding a tool and for transmitting a torque onto the tool that makes it possible—with an unchanged construction of the tool and its insertion end—to transmit higher impact energies and torques to the tool without placing a higher degree of stress on the insertion end, or even damaging the insertion end.

According to the present invention, this object is achieved by a device as recited in patent claim 1. Advantageous further developments of the present invention are defined in the dependent claims.

In a device according to the present invention, the tool receptacle has, in a known manner, a tool holder on whose inside at least one rotational driver, as well as at least one locking element that can be moved between a locked state and an unlocked state, are provided. The tool holder is formed by an essentially hollow cylindrical recess having on an end surface an introduction opening for an insertion end of the (preferably collarless) tool, and having on an opposite end surface an impact opening through which an impact effect can be applied to the insertion end. According to the present invention, an impact surface acting in the axial direction of the tool holder is provided on an inner wall of the tool holder in the area of the impact opening.

The one rotational driver, or, preferably, the two or more rotational drivers, can be formed in the shape of webs. Alternatively, other shapes are also possible that enable a torque to be transmitted to the tool. In particular, the rotational driver elements can also be formed in the shape of an inner hexagon into which a hexagonal insertion end can be introduced. In this way, the hexagonal surfaces of the rotational drivers work together with the hexagonal surfaces of the insertion end (rotational driver surfaces). It is likewise possible to fashion the rotational drivers in such a way that, for example, they work together with a splined insertion end.

In general, corresponding rotational driver surfaces on the insertion end are allocated to the rotational drivers formed on the inside of the tool holder. If, as in the SDS-max system, the rotational drivers are web-shaped, the rotational driver surfaces can be realized in the form of rotational driver grooves in the insertion end.

Even if, for example, the insertion end has a hexagonal cross-section, and the tool holder is correspondingly formed in the shape of an inner hexagon, it is still possible to speak of a "hollow cylindrical" recess with regard to the tool holder. The designation "hollow cylindrical" is thus not strictly limited to inner cylinders, but also includes hollow prismatic shapes, such as for example the inner hexagon, an inner square, etc.

The stop surface acts as a stop for the insertion end of the tool. The stop surface makes it possible for the insertion end to be capable of being fixed at one side, opposite the tool holder, in its axial end position, which in general also corresponds to the impact position, without feedback effects being able to act on the percussive system, in particular the pneumatic spring hammer mechanism. In previously known solutions, an intermediate header (see e.g. reference character 2 in FIG. 1) was always required that not only had to transmit the impact energy to the insertion end but was also used for the axial positioning of the insertion end.

The stop surface according to the present invention is completely separate from the functioning of the transmission of the impact, and is used to support the pressure forces applied by the operator, as well as the relatively weak B-impacts, as they are known (recoil impacts of the chisel, especially when the subsoil is hard).

Due to the provision of the stop surface, the previously standard intermediate header is dispensable, so that the concomitant disadvantages are no longer present. The sealing of the pneumatic spring hammer mechanism against the penetration of foreign bodies and against an uncontrolled exiting of lubricant from the hammer mechanism, normally effected by the intermediate header, is effectively replaced by an impact piston guide that is explained in more detail below.

Preferably, the stop surface is stationary in relation to the tool holder, and is provided on the inner wall of the hollow cylindrical recess. In particular, the stop surface is fashioned on the end surface of the recess, which also has the impact opening.

In a variant of the present invention, the stop surface is likewise provided on the inner wall of the tool holder. However, it can for example be made of an elastic material (e.g. plastic or rubber), and thus can have a certain elasticity. In another variant, the stop surface can be fashioned for example on a sleeve that can be moved axially on the inner wall of the tool holder, against the action of a spring device. Here as well, the stop surface is provided on the inner wall of the tool holder, but is not strictly speaking stationary. If, in the description below, a "stationary" stop surface is discussed, this is expressly intended also to include the variants described here of stop surfaces that can be moved against an elastic action. The movable stop surfaces are also to be regarded as stationary, at least in the idle state when they are not receiving an impact from the insertion end. Thus, all statements in the following relating to stationary stop surfaces are equally valid for movable stop surfaces.

In a particularly advantageous specific embodiment of the present invention, the stop surface is fashioned conically, so that an introductory beveling in the shape of a truncated cone fashioned on the end surface of the tool insertion end can come to rest against it. The insertion end of tools offered for example under the trade name "SDS-max" standard has a relatively large introductory beveling (chamfering) in the shape of a truncated cone, in order to ensure a quick and easy introduction of the insertion end into the tool receptacle even in rough work conditions on construction sites. According to the present invention, this conical surface is now allocated to the conical stop surface in the tool holder, ensuring a large-surface and therefore reliable stop.

In a particularly advantageous embodiment of the present invention, the rotational driver or drivers on the inside of the tool holder extend axially up to the stop surface.

Previously, it was standard for the rotational drivers to have only a limited axial extension, corresponding for example to the length shown in FIG. 1 of through-holes 9 for locking elements 8. This not only has the disadvantage of, for example, increased wear on the side surfaces of the rotational driver grooves in the insertion ends due to an increased surface pressure between the rotational drivers and the rotational driver surfaces (rotational driver grooves); in addition, in tool receptacles as previously used there is the danger that the insertion ends, which extend far beyond the rotational drivers into the interior of the tool receptacle, in particular the end surfaces of these ends, will become flattened by the action of the impact energy, so that the rotational driver surfaces (rotational driver grooves) at the end surface of the insertion end become forged to a point or sharpened. This can have the result that the tool can no longer be withdrawn from the tool receptacle, in particular if it is made of a cheaper, too-soft material.

The feature of the present invention according to which the e.g. web-shaped rotational drivers now extend up to the end of the tool holder at the side of the hammer mechanism, i.e., up to the stop surface, prevents such a hammering of the rotational driver surfaces or rotational driver grooves in the insertion end.

In the case of other insertion ends, which can have e.g. a hexagonal cross-section, it is not necessary for a web-shaped rotational driver to be present. Rather, here the rotational drivers can be fashioned as surfaces of an internal hexagon that transmit the torque to the associated rotational driver surfaces on the insertion end. Here as well, however, the rotational drivers extend up to the end of the tool holder at the side of the hammer mechanism.

As already stated, the construction according to the present invention of the tool receptacle also enables an optimization of the shape of the impact piston. In a particularly advantageous specific embodiment of the present invention, the impact piston therefore has a shaft that can be guided in an impact piston guide. The impact piston itself can have for example a massive construction, a hollow construction (hollow beater) also being possible.

The impact piston guide is connected directly to the tool holder, so that the stop surface is advantageously situated at a transition from the hollow piston guide to the tool holder.

As a result of this construction, the impact energy of the impact piston can be transmitted directly via its shaft to the insertion end, without its being necessary to provide an intermediate header, as is the case in the prior art.

In a further development of the present invention, the impact piston guide has a hollow cylindrical construction, and has at least one, but preferably several, tangentially circumferential grooves on its inside. During operation of the hammer mechanism, the grooves can be filled with lubricant, in particular grease, in order on the one hand to ensure a sufficient lubrication of the impact piston guide, and on the other hand to ensure a sealing of the pneumatic spring hammer mechanism against influences that can enter the drilling and/or percussive hammer from the outside via the tool receptacle.

Advantageously, the tolerance of the outer diameter of the shaft of the impact piston, and of the inner diameter of the impact piston guide, is selected such that a gap is formed through which lubricant can travel from the pneumatic spring hammer mechanism into the tool holder. In contrast to the previously standard header solutions, this type of impact piston guide causes grease or dirt particles adhering to the impact piston shaft to travel towards the front, in the direction of the tool receptacle, due to the very abrupt delay of the impact piston during the impact. In this way, dirt is not only transported out of the area of the pneumatic spring hammer mechanism; moreover, the tool receptacle and the insertion end of the tool are automatically lubricated, so that the previously standard separate lubrication is no longer required. Of course, the gap, i.e. the tolerance between the impact piston shaft and the impact piston guide, should be dimensioned such that only relatively small quantities of grease can leak.

In another further development of the present invention, the diameter of the shaft of the impact piston is smaller than the outer diameter of the insertion end, and is preferably even smaller than the inner diameter, i.e., the smallest diameter, of the truncated-cone-shaped introductory beveling of the insertion end. In the case of recoil impacts, this prevents the insertion end itself from striking, with its cone-shaped introductory beveling, a kind of "mushrooming" on the stationary stop surface in the tool holder, which could in the worst case result in the striking shaft becoming stuck.

In addition, it is advantageous if the diameter of the impact piston shaft is smaller than the diameter of a fictitious cylinder that can be placed in the internal space of the tool holder between the rotational drivers. In this way, the impact piston shaft can also penetrate into the area of the rotational drivers without touching these drivers or even striking these drivers.

The described specific embodiments can also be varied in that an intermediate piston or intermediate header is retained as an impact element that transmits the impact energy of the impact piston to the insertion end. In this case, the diameter limitations described in the foregoing for the shaft of the impact piston are correspondingly valid for the impact element (intermediate piston), or its shaft dimensions. An intermediate piston can for example be advantageous in impact pistons having a short construction, so that a better sealing from the hammer mechanism is possible.

The described device is suitable not only for the mentioned SDS-max system, but also for other types of tool holders or tool insertion ends. The tools themselves are often manufactured without a collar that terminates the insertion end, which is advantageous in terms of cost. Of course, it is however also possible to provide the tool with a collar on the end of the insertion end oriented towards the tool tip.

These and additional advantages and features of the present invention are explained in more detail in the following on the basis of an example, with the aid of the accompanying Figures.

DETAILED DESCRIPTION OF THE PREFERRED EMBODIMENT

Figure 1:
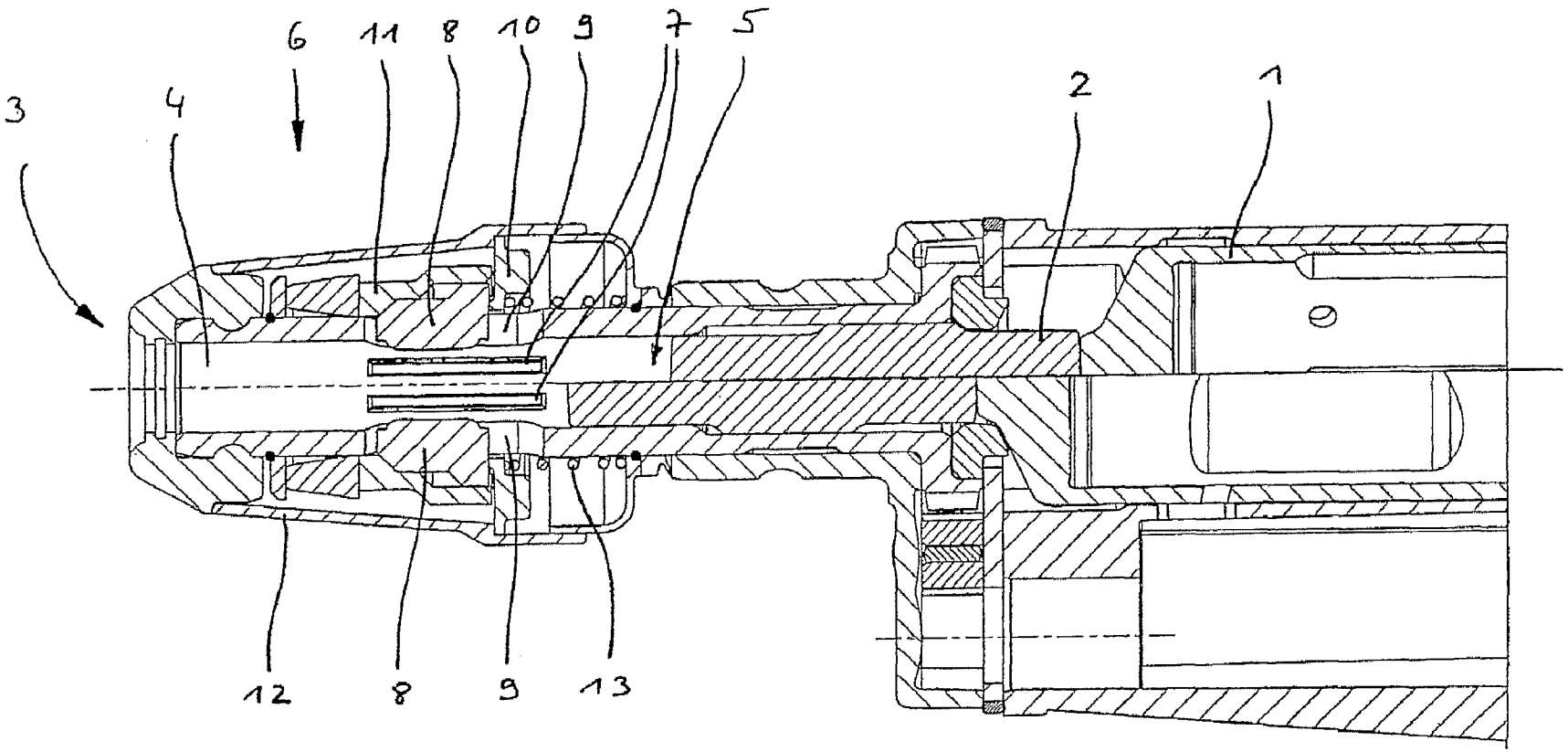
FIG. 1 shows a sectional view of a tool receptacle area of a known tool system (SDS-max)
Figure 2:
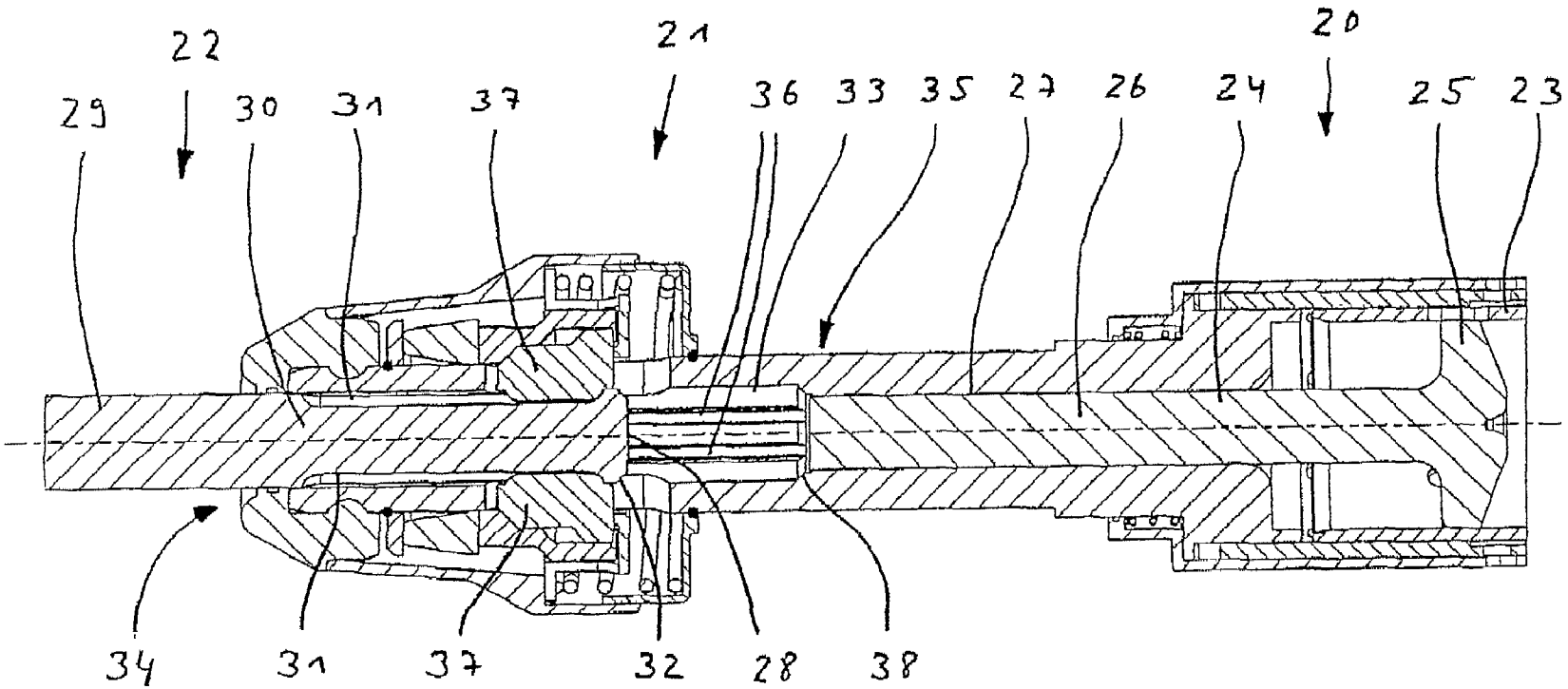
FIG. 2 shows a device according to the present invention in a sectional representation.
Figure 3:
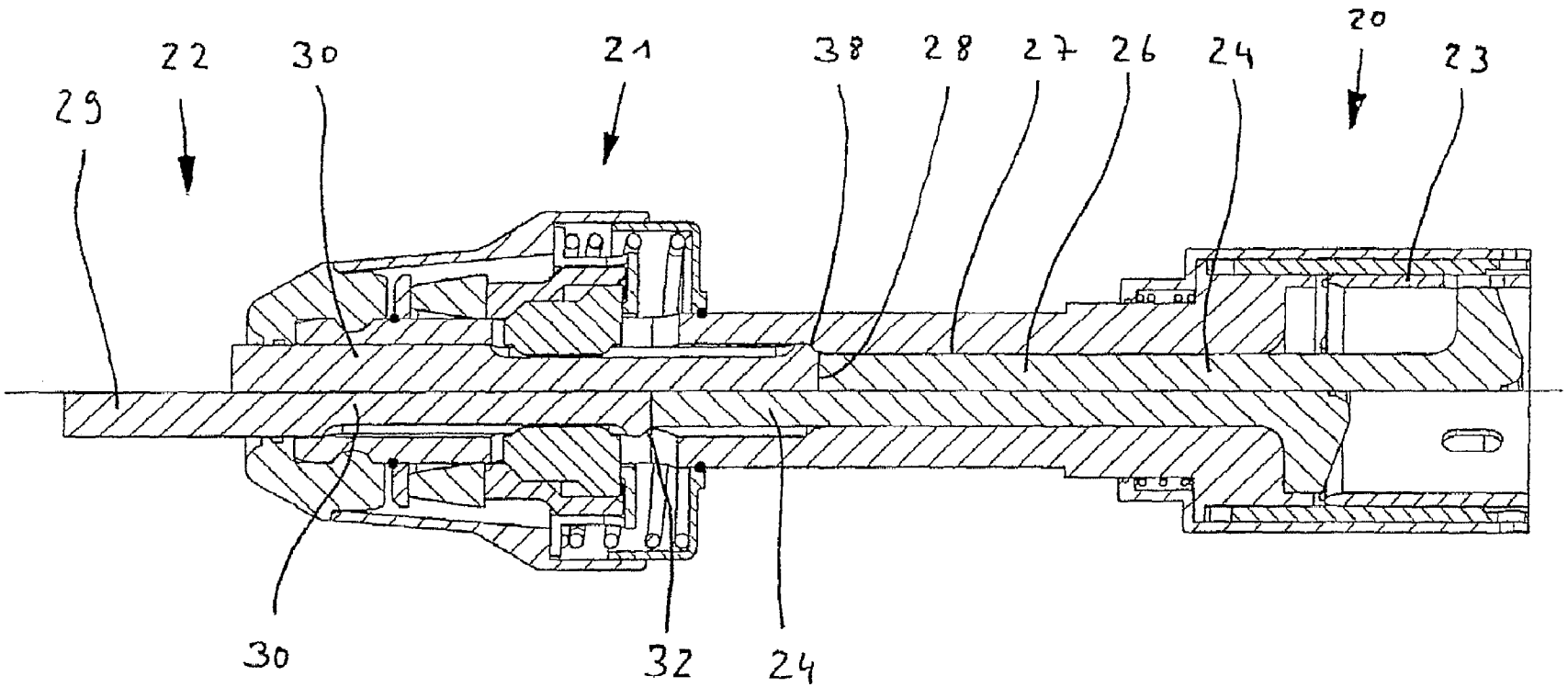
FIG. 3 shows the device according to the present invention in the impact position and the no-load position.
Figure 4:
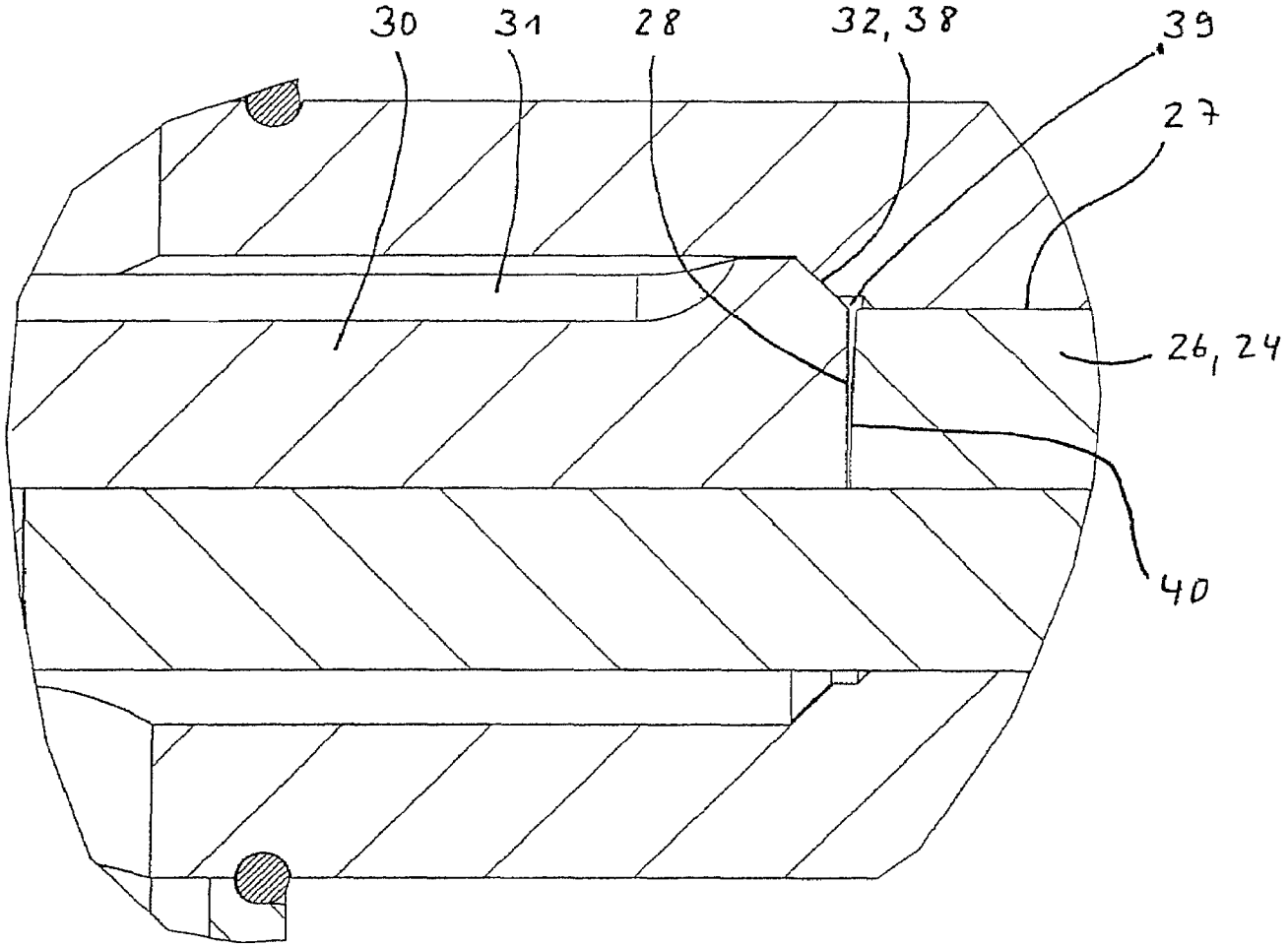
FIG. 4 shows an enlarged detail of the area of the stop surface from FIG. 3.

FIGS. 2 to 4 relate to the same specific embodiment of the device according to the present invention, and are described at least partly in parallel in the following.

The device is a component of a drilling and/or percussive hammer, designated "hammer" in the following, of which, however, here only a pneumatic spring hammer mechanism 20, a tool receptacle 21, and a part of a tool 22 are shown. Additional areas of the hammer are not shown because they are not relevant to the present invention.

A drive piston 23, shown only partly in the Figures, is moved back and forth axially by a drive (motor with crank drive) in a known manner. Via a pneumatic spring (not shown) acting between drive piston 23 and an impact piston 24, impact piston 24 is likewise moved back and forth axially. Impact piston 24 has a piston plate 25 and a shaft 26 that is guided in an impact piston guide 27, mounted in the hammer, so as to be capable of axial movement. Due to the omission of an intermediate header, it is possible to construct impact piston guide 27 in relatively simple fashion as a guide sleeve, without having to use a plurality of additional constructive elements. Shaft 26 strikes an end surface 28 of an insertion end 30 belonging to a tool 29, as can be seen e.g. in the upper part of FIG. 3.

Impact piston 24 and impact piston guide 27 are capable of rotation together with tool receptacle 21, so that they can be driven in rotational fashion by the drive of the hammer. The rotational movement is then transmitted to tool 22 in order to achieve a drilling effect.

Insertion end 30 is constructed according to the generally known standard "SDS-max," and can have the features that are for example also described in DE 37 16 915 A1. These include at least two rotational driver grooves (not shown in the Figures) that open out at the end of insertion end 30 belonging to tool 29, as well as two locking recesses 31 situated diametrally opposite one another. An introductory beveling 32 having the shape of a truncated cone is provided on end surface 28 of insertion end 30.

Tool receptacle 21 has an essentially hollow cylindrical recess that forms a tool holder 33. On an end surface of tool holder 33, an introduction opening 34 is provided through which insertion end 30 can be introduced, in the manner shown in FIGS. 2 and 3. On the end surface of tool holder 33 situated axially opposite the introduction opening, an impact opening 35 is provided through which an impact action of impact piston 24 or of shaft 26 can be applied to end surface 28 of the insertion end.

Impact opening 35 thus forms the transition between impact piston guide 27 and tool holder 33. Impact opening 35 need not necessarily be a feature that is precisely physically defined. Rather, it can be a transition area in which the impact energy of impact piston 24 is transmitted to insertion end 30.

In addition, tool receptacle 21 has one, or preferably several, web-shaped rotational drivers 36 that extend axially on the inner side of tool holder 33. Two of the rotational drivers 36 can be seen in FIG. 2. The number of rotational drivers 36 is matched to the number of rotational driver grooves (not shown), so that the rotational driver grooves are capable of being pushed onto rotational drivers 36.

In addition, tool receptacle 21 has two locking elements 37 that each engage in the respectively allocated locking recess 31 in insertion end 30, as can be seen in FIGS. 2 and 3.

The principle of the locking and unlocking of locking elements 37 in locking recesses 31 is known, and has already been described above with reference to the prior art. A repetition of this description here is therefore unnecessary.

In the area of impact opening 35, a stationary (in relation to tool holder 33) stop surface 38 is provided. The stop surface acts at least partly in the axial direction of tool holder 33, in such a way that introductory beveling 32 of insertion end 30 can come to rest against it, as is shown for example in the upper part of FIG. 3. In this position, shaft 26 of impact piston 24 can optimally meet end surface 28 of insertion end 30. However, end surface 28 can also receive an impact from shaft 26 in other positions as well.

Instead of stationary stop surface 38, in another specific embodiment (not shown) of the present invention a stop surface that is capable of axial movement relative to tool holder 33 against the action of a spring device can also be provided. Thus, it is for example possible to form the stop surface itself from an elastic material (e.g., rubber or plastic). Alternatively, the stop surface can also be provided on a sleeve that is capable of axial movement against the action of a spring device supported on the tool holder.

As can be seen in FIG. 2, web-shaped rotational drivers 36 extend up to impact opening 35, or stop surface 38. In this way, torque is always transmitted to insertion end 30 over a maximum possible length by rotational drivers 36 and the rotational driver grooves.

The depth of the rotational driver grooves is preferably dimensioned such that the rotational driver grooves run out in the area of introductory beveling 32 without penetrating end surface 28. In this way, it can be ensured that even in the case of an at least slight "mushrooming" of end surface 28 due to the impact effect of impact piston 24, the rotational driver grooves are not deformed, so that tool 22 can be removed from tool receptacle 21 at any time.

FIG. 3 shows impact piston 24 and insertion end 30 in different positions; the upper part of the Figure shows the normal impact position, in which impact piston 24 strikes end surface 28 of insertion end 30 in order to transmit the impact, while the lower part of the Figure shows no-load operation, in which insertion end 30 slides out of the housing of the hammer and is prevented from sliding completely out of the housing only by locking elements 37. In the no-load position, impact piston 24 follows insertion end 30 and is situated in its frontmost position. Due to a corresponding construction of pneumatic spring hammer mechanism 20, impact piston 24 is prevented from further movement and from exerting impacts on insertion end 30. The construction of pneumatic spring hammer mechanism 20 required for this is known, so that a more detailed presentation is not necessary here.

FIG. 4 shows an enlarged detail of the area around stop surface 38 of FIG. 3.

Insertion end 30 strikes stop surface 38 with its introductory beveling 32. The inner diameter, i.e., smallest diameter, of introductory beveling 32 is here somewhat smaller than is the inner diameter of stop surface 38. Moreover, the diameter of impact piston guide 27 is in turn somewhat smaller than is the inner diameter of stop surface 38. In this way, there results an open area 39 into which material of insertion end 30 can move if end surface 28, or the edge running on the inner diameter of introductory beveling 32, should become somewhat "mushroomed" due to the impact effect of shaft 26.

A stop surface 40 of impact piston 24 has a slight curvature, visible in FIG. 4, so that the initial contact between impact surface 40 and end surface 28 takes place approximately in the area of the midaxis. In this way, a considerable part of the impact energy is applied centrically to insertion end 30. At the same time, undesirable deformations in the edge area, i.e., on introductory beveling 32, are avoided.

The diameter of shaft 26 of impact piston 24 can be somewhat smaller than the inner diameter of introductory beveling 32 of insertion end 30.

The particular shape of tool holder 33 makes it possible for insertion end 30 to be guided radially over its entire insertion length introduced into tool holder 33. In this way, the wear on insertion end 30 can be significantly reduced. Because web-shaped rotational drivers 36 run out in the area of stop surface 38, it is not necessary to provide enlargements, before and after the rotational drivers, of the diameter of tool holder 33, in which for example a broach could run in and out. Such a requirement does exist in the shorter rotational drivers of the prior art, where the guiding of the insertion end is possible only in the area of the rotational drivers. Due to the fact that according to the present invention the rotational drivers have a significantly greater axial extension, the radial guiding of insertion end 30 can also take place over a longer area.

The present invention enables the use of already-known tools having insertion ends constructed according to the "SDS-max" standard, even in devices having significantly higher power. If, in such devices, the previously used "SDS-max" standard were also to be retained at the side of the tool receptacle, the insertion ends of the tools would be destroyed in a fairly short time. Of course, the present invention can also advantageously be used in insertion systems other than the "SDS-max" standard.

We claim:

1. A device for a drilling and/or percussive hammer having a tool receptacle for holding a tool and for transmitting a torque to the tool, the tool receptacle comprising:

an essentially hollow cylindrical recess that forms the tool holder, having on an end surface an introduction opening through which an insertion end of the tool can be introduced, and having on an opposite end surface an impact opening through which an impact action can be applied to an end surface of the insertion end of the tool, at least one web-shaped rotational driver formed on an inner side of the tool holder, and additionally, at least one locking element that, in a locked state, is held in a predetermined radial position, and, in an unlocked state, is capable of movement at least radially out of the predetermined radial position, wherein a stop surface is provided on an inner wall of the tool holder in the area of the impact opening, the stop surface acting in the axial direction of the tool holder such that the stop surface limits axial travel of the tool into the tool holder when the end surface of the tool abuts the stop surface.

2. The device as recited in claim 1, wherein the stop surface has a conical construction.

3. The device as recited in claim 1, wherein the tool has:

the insertion end, which is essentially cylindrical and is formed by a tool shaft, at least one rotational driver surface that is formed on the insertion end and opens out at the end of the tool shaft, at least one locking recess that is formed in the insertion end and is closed on both sides in the axial direction of the tool shaft; and wherein the rotational driver is allocated to the respective rotational driver surface, and is fashioned such that the rotational driver surface can be pushed onto the rotational driver when the tool is introduced.

4. The device as recited in claim 1, wherein an introductory beveling having the shape of a truncated cone is provided on the end surface of the insertion end of the tool.

5. The device as recited in claim 1, wherein the rotational driver extends axially on the inside of the tool holder up to the stop surface.

6. The device as recited in claim 1, wherein the insertion end is guided radially over its entire insertion length introduced into the tool holder.

7. The device as recited in claim 1, wherein in the drilling and/or percussive hammer there is provided a pneumatic spring hammer mechanism having a drive piston that is capable of being moved back and forth by a drive, and having an impact piston that is capable of being driven by the drive piston, the impact piston has a shaft that is capable of being guided in an impact piston guide, and wherein the stop surface is situated at a transition from the impact piston guide to the tool holder.

8. The device as recited in claim 7, wherein the impact energy of the impact piston is capable of being transmitted via its shaft directly to the insertion end.

9. The device as recited in claim 7, wherein the impact piston guide has a hollow cylindrical construction and has at least one tangentially peripheral groove on its inside.

10. The device as recited in claim 7, wherein the tolerance of the outer diameter of the shaft of the impact piston and of the inner diameter of the impact piston guide are selected such that a gap is formed through which lubricant can flow from an area of the pneumatic spring hammer mechanism into the tool holder.

11. The device as recited in claim 7, wherein the diameter of the shaft of the impact piston, or of an impact element that transmits the impact energy of the impact piston to the insertion end, is smaller than the outer diameter of the insertion end.

12. The device as recited in claim 7, wherein the diameter of the shaft of the impact piston, or of an impact element that transmits the impact energy of the impact piston to the insertion end, is smaller than the inner diameter of the introductory beveling, having the shape of a truncated cone, of the insertion end.

13. The device as recited in claim 7, wherein the diameter of the shaft of the impact piston, or of an impact element that transmits the impact energy of the impact piston to the insertion end, is smaller than the diameter of a fictitious cylinder that is capable of being placed into the interior space in the tool holder between the rotational driver or drivers.

14. The device as recited in claim 1, wherein the stop surface is stationary in relation to the tool holder.

15. A tool holder for holding a tool of a drilling and/or percussive hammer and for transmitting a torque to the tool, the tool holder comprising:

a device having a an essentially hollow cylindrical recess that holds the tool, the recess having, on a first end surface there of, an introduction opening through which an insertion end of the tool is introduced, and having, on an second end surface thereof that is opposite the first end surface, an impact opening through which an impact action is applied to the insertion end, at least one web-shaped rotational driver formed on an inner side of the recess, at least one locking element that is located, at least in part, into the recess and that, in a locked state thereof, is held in a predetermined radial position, and, in an unlocked state thereof, is capable of movement at least radially out of the predetermined radial position, and a stop surface that is provided on an inner wall of the recess axially adjacent the impact opening and that restricts axial travel of the tool into the recess when a tool end surface abuts the stop surface, wherein, in operation of the hammer, initial contact between the tool end surface and an impact piston occurs adjacent the stop surface.

16. The device as recited in claim 15, wherein the stop surface interfaces a beveled surface of the tool that tapers from an end surface that is impacted by the impact piston.

17. The device as recited in claim 16, wherein the beveled surface of the tool is longer than the stop surface such that, when the tool is seated against the stop surface, the beveled surface extends beyond the stop surface and into the impact opening.

18. In combination:

a tool that is configured as a drill or chisel for use with a drilling and/or percussive hammer, the tool including:

an elongate shaft, an insertion end defined at a first end of the shaft and defining a tool end surface thereof, a work end defined at a second, opposing, end of the shaft; and a drilling and/or percussive hammer, including:

a pneumatic spring hammer mechanism, an impact piston cooperating with and being driven into reciprocating motion by the pneumatic spring hammer mechanism, and a tool holder aligned with the impact piston and positioning the tool for receipt of impact actions delivered by the impact piston, the tool holder including:

a device having an essentially hollow cylindrical recess that holds the tool, the recess having, on a first end surface thereof, an introduction opening through which the insertion end of the tool is introduced, and having, on an second end surface thereof that is opposite the first end surface, an impact opening through which the impact actions are applied to the insertion end of the tool, at least at least one web-shaped rotational driver formed on an inner side of the recess, at least one locking element that extends, at least in part, into the recess and that, in a locked state thereof, is held in a predetermined radial position, and, in an unlocked state thereof, is capable of movement at least radially out of the predetermined radial position, and a stop surface that is provided on an inner wall of the recess axially adjacent the impact opening and abutting the tool end surface so as to restrict axial travel of the tool into the recess, wherein, in operation of the hammer, initial contact between the tool end surface and the impact piston occurs adjacent the stop surface, such that the tool end surface (i) contacts the stop surface when traveling toward the pneumatic spring hammer mechanism, and (ii) is contacted by the impact piston which drives the tool away from the pneumatic spring hammer mechanism.

19. The combination as recited in claim 18, wherein the at least one web-shaped rotational driver extends axially to the stop surface such that, during use of the hammer, the stop surface supports pressure forces applied by the operator to the drilling and/or percussive hammer.

20. The combination as recited in claim 18, wherein the tool end surface comprises a beveled portion that contacts the stop surface and a planar portion that is contacted by the impact piston.

* * * * *

UNITED STATES PATENT AND TRADEMARK OFFICE

CERTIFICATE OF CORRECTION

PATENT NO. : 7,661,484 B2
APPLICATION NO. : 10/596334
DATED : February 16, 2010
INVENTOR(S) : Berger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 455 days.

Signed and Sealed this

Thirtieth Day of November, 2010

David J. Kappos

David J. Kappos
*Director of the United States Patent and Trademark Office*